US007625052B2

(12) United States Patent
Kim et al.

(10) Patent No.: US 7,625,052 B2
(45) **Date of Patent: *Dec. 1, 2009**

(54) REFRIGERATOR AND REFRIGERATOR CONTAINER MOVING SYSTEM

(75) Inventors: Sang Oh Kim, Seoul (KR); Seung Hwan Oh, Su-ri -si (KR); Kyung Han Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 402 days.

This patent is subject to a terminal disclaimer.

(21) Appl. No.: 11/256,990

(22) Filed: Oct. 25, 2005

(65) Prior Publication Data

US 2006/0207283 A1 Sep. 21, 2006

(30) Foreign Application Priority Data

Mar. 2, 2005 (KR) ..... 10-2005-0017459

(51) Int. Cl.
*A47B 88/00* (2006.01)

(52) U.S. Cl. ..... 312/402; 312/410

(58) Field of Classification Search ..... 312/402, 312/404, 330.1, 298, 301, 292, 312, 310, 312/302, 319.5–319.8; 62/382, 407
See application file for complete search history.

(56) References Cited

U.S. PATENT DOCUMENTS 149,255 A * 3/1874 Semmendinger ..... 108/7
396,741 A * 1/1889 Healey ..... 108/96
1,934,370 A * 11/1933 Mirabella ..... 312/266
2,497,734 A * 2/1950 Kuklich ..... 312/312
2,769,676 A * 11/1956 Larsen et al. ..... 312/306
2,861,857 A * 11/1958 Lee et al. ..... 312/312
3,028,210 A * 4/1962 Byars ..... 312/312
3,500,486 A * 3/1970 Le Clear ..... 14/71.3
3,862,788 A * 1/1975 Hock et al. ..... 312/294
4,151,804 A * 5/1979 Wache et al. ..... 108/147
4,568,132 A * 2/1986 Watt ..... 312/312
4,790,611 A * 12/1988 Craner ..... 312/306
5,301,992 A * 4/1994 Whitmore ..... 296/37.1
5,429,043 A * 7/1995 Becker ..... 99/448
D387,923 S * 12/1997 McKinney ..... D6/429
5,820,234 A * 10/1998 Capwell et al. ..... 312/216
5,971,513 A * 10/1999 Cassalia ..... 312/310
6,494,150 B1 * 12/2002 Phoenix et al. ..... 108/147
7,396,093 B2 * 7/2008 Jeong et al. ..... 312/402

(Continued)

FOREIGN PATENT DOCUMENTS

JP 2-136686 A 5/1990

(Continued)

*Primary Examiner*—Janet M Wilkens
(74) *Attorney, Agent, or Firm*—Birch, Stewart, Kolasch & Birch, LLP

(57) ABSTRACT

A refrigerator and a container moving system for a refrigerator are provided. The refrigerator includes a main body including at least one chamber; a container disposed in the chamber, the container being movable along a first direction and along a second direction; a door located on the main body, the container being moveable along the first direction by moving the door along the first direction; a motor, the container being movable along the second direction by the motor; and a battery electrically connected to the motor to supply power to the motor.

15 Claims, 6 Drawing Sheets

U.S. PATENT DOCUMENTS

2002/0171335 A1* 11/2002 Held ..... 312/223.6
2004/0244825 A1* 12/2004 Ashton ..... 134/85
2005/0073225 A1 4/2005 Kwon et al.
2006/0042304 A1* 3/2006 Oh et al. ..... 62/407
2006/0104756 A1* 5/2006 Kim et al. ..... 414/288
2006/0108900 A1* 5/2006 Lee ..... 312/319.6
2008/0018215 A1* 1/2008 Carden et al. ..... 312/404

FOREIGN PATENT DOCUMENTS

JP 4-359781 A 12/1992
JP 5-296647 A 11/1993
JP 3880999 * 2/2007
KR 1998-0026269 7/1998

* cited by examiner

REFRIGERATOR AND REFRIGERATOR CONTAINER MOVING SYSTEM

This Nonprovisional application claims priority under 35 U.S.C. §119(a) on Patent Application No. 10-2005-0014759 filed in Korea on Mar. 2, 2005, the entire contents of which are hereby incorporated by reference.

BACKGROUND OF THE INVENTION

1. Field of the Invention

The present invention relates to a refrigerator, and more particularly, to a bottom freezer type refrigerator and container moving system, in which a container of a freezing chamber can be automatically moving along a horizontal or vertical direction.

2. Description of the Related Art

Refrigerators can be classified into several types depending on the locations of a freezing chamber and a chilling chamber. For example, a top mount refrigerator includes a freezing chamber and a chilling chamber that are partitioned up and down, a side-by-side refrigerator includes a freezing chamber and a chilling chamber that are partitioned left and right, and a bottom freezer refrigerator includes a freezing chamber and a chilling chamber that are partitioned down and up.

Although the bottom freezer refrigerator is illustrated to describe the present invention, the present invention is not limited to this particular type of refrigerator.

The bottom freezer refrigerator includes a chilling chamber door and a freezing chamber door. Although the chilling chamber door is a hinged door like other types of refrigerators, the freezing chamber door is a drawer type door because the freezing chamber is relatively small and located at a lower portion of the refrigerator.

Therefore, what is needed is a simple, easy, and convenient way to stow and remove food in the freezing chamber.

SUMMARY OF THE INVENTION

Accordingly, the present invention is directed to a refrigerator and refrigerator container moving system that substantially obviates one or more problems due to limitations and disadvantages of the related art.

An object of the present invention is to provide a refrigerator and refrigerator container moving system that gives a more convenient way of putting food in the refrigerator and taking food out of the refrigerator.

Another object of the present invention is to provide a refrigerator and refrigerator container moving system that has a simple and effective power supply unit for moving a container along a horizontal or vertical direction.

A further another object of the present invention is to provide a refrigerator and refrigerator container moving system that gives a convenient way of handling a container installed in a drawer type door.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a refrigerator including: a main body including at least one chamber; a container disposed in the chamber, the container being movable along a first direction and along a second direction; a door located on the main body, the container being moveable along the first direction by moving the door along the first direction; a motor, the container being movable along the second direction by the motor; and a battery electrically connected to the motor to supply power to the motor.

In another aspect of the present invention, there is provided a refrigerator including: a main body including a chamber; a door for opening and closing the chamber; a container supporter located on a side of the door facing the chamber; a rotary arm connected to the container supporter, the container supporter being movable along a first direction by rotating the rotary arm; a motor for driving the rotary arm; and a power supply unit to supply power to the motor when the door is open.

In a further another aspect of the present invention, there is provided a container moving system for a refrigerator with a door, the system including: a container supporter located on a side of the door; a container seated on the container supporter; a power supply unit, the power supply unit being chargeable when the door is closed; and a motor located on the side of the door to move the container supporter along a first direction.

According to the present invention, food can be more conveniently put in and taken out of the refrigerator.

Further, the power requiring for moving the container can be supplied in a simple, reliable, and convenient way. Therefore, the refrigerator can have an improved outer appearance and it can be conveniently used.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE EMBODIMENTS

Figure 1:
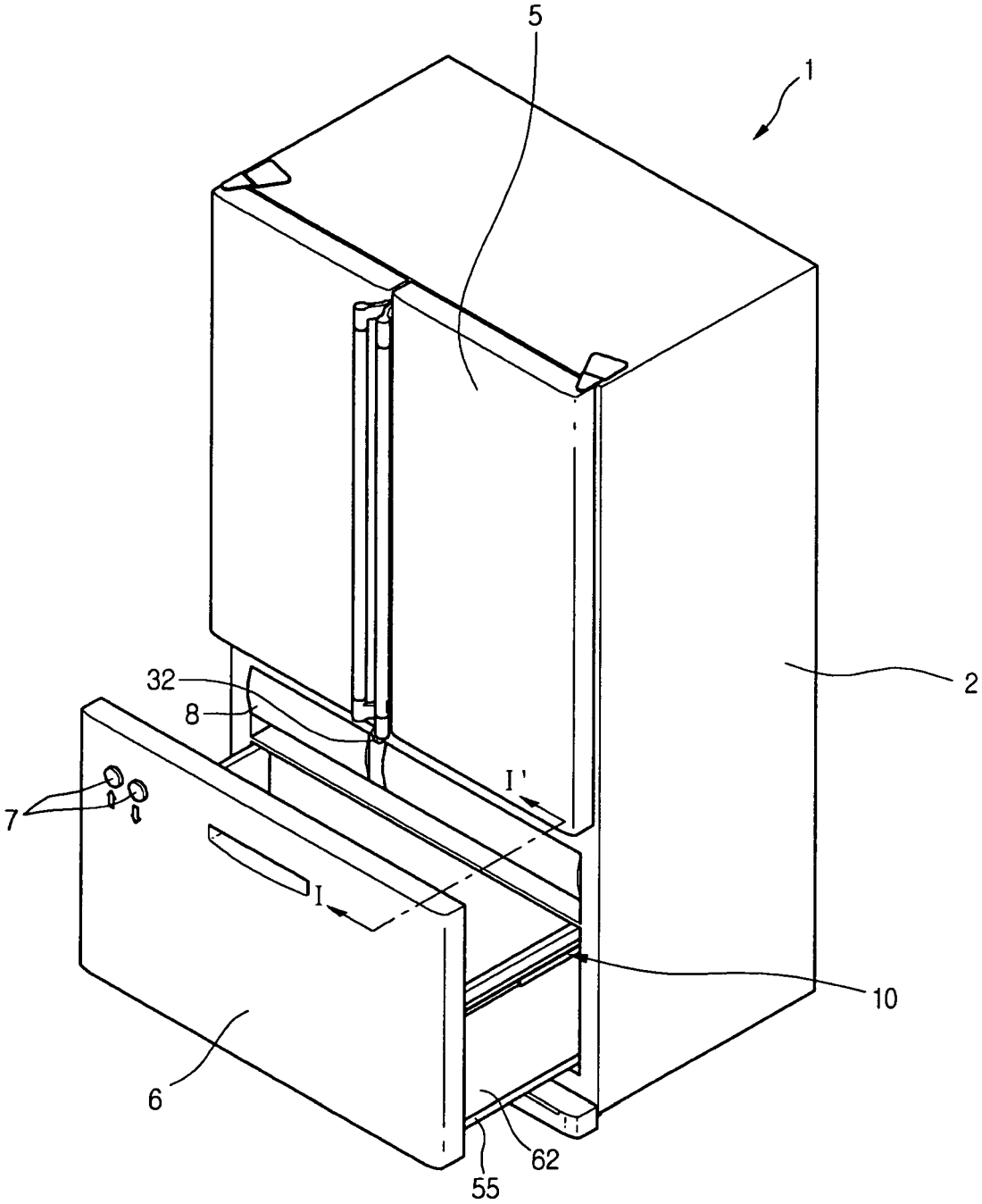
FIG. 1 is a perspective view of a refrigerator equipped with a container moving system according to an embodiment of the present invention.

Reference will now be made in detail to the preferred embodiments of the present invention, examples of which are illustrated in the accompanying drawings. FIG. 1 is a perspective view of a refrigerator equipped with a container moving system according to an embodiment of the present invention. Referring to FIG. 1, a refrigerator 1 is a bottom freezer type refrigerator that includes a freezing chamber at a lower portion and a freezing chamber door capable of sliding along a horizontal direction, e.g., the forward and backward directions.

In detail, the refrigerator 1 includes a main body 2, first doors 5, a second door 6, a slider 10, a first chamber (refer to the reference numeral 3 in FIG. 2), a second chamber (refer to the reference numeral 4 in FIG. 2), drawers 8, a container supporter 55, and a power supply terminal 32. The first doors 5 are hinged on a front upper portion of the main body 2 to open and close the first chamber 3. The second door 6 is slidably installed at a front lower portion of the main body 2 to open and close the second chamber 4. The slider 10 is connected between the main body 2 and the second door 6 to enable the sliding of the second door 6 in forward and backward directions. The drawers 8 are formed under the first chamber 3 to store food. The power terminal 32 is formed above or between the drawers 8 to supply power to a container moving system (as will be described later) for lifting the container supporter 55.

Further, the refrigerator 1 includes a control panel such as control switch buttons 7 at a front side of the second door 6 and a container 62 behind the second door 6. The control switch buttons 7 are formed at a front side of the second door 6 for controlling the operation of the second door 6. The container 62 is supported by the container supporter 55 to store food. The container 62 can be vertically lifted by lifting the container supporter 55. That is, the container 62 may be lifted up for an easy access to food in the container 62, and it may be lowered down to open and close the second door 6.

Figure 2:
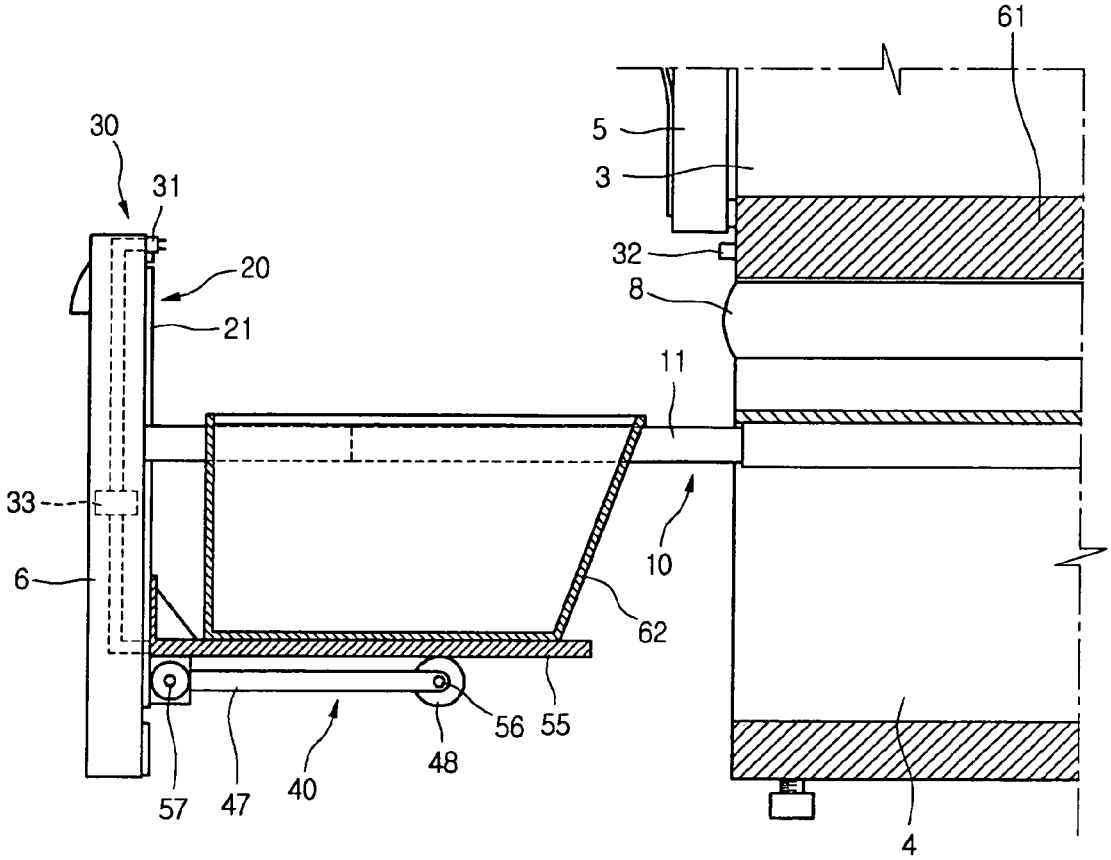
FIG. 2 is a sectional view taken along line I-I' in FIG. 1.
Figure 3:
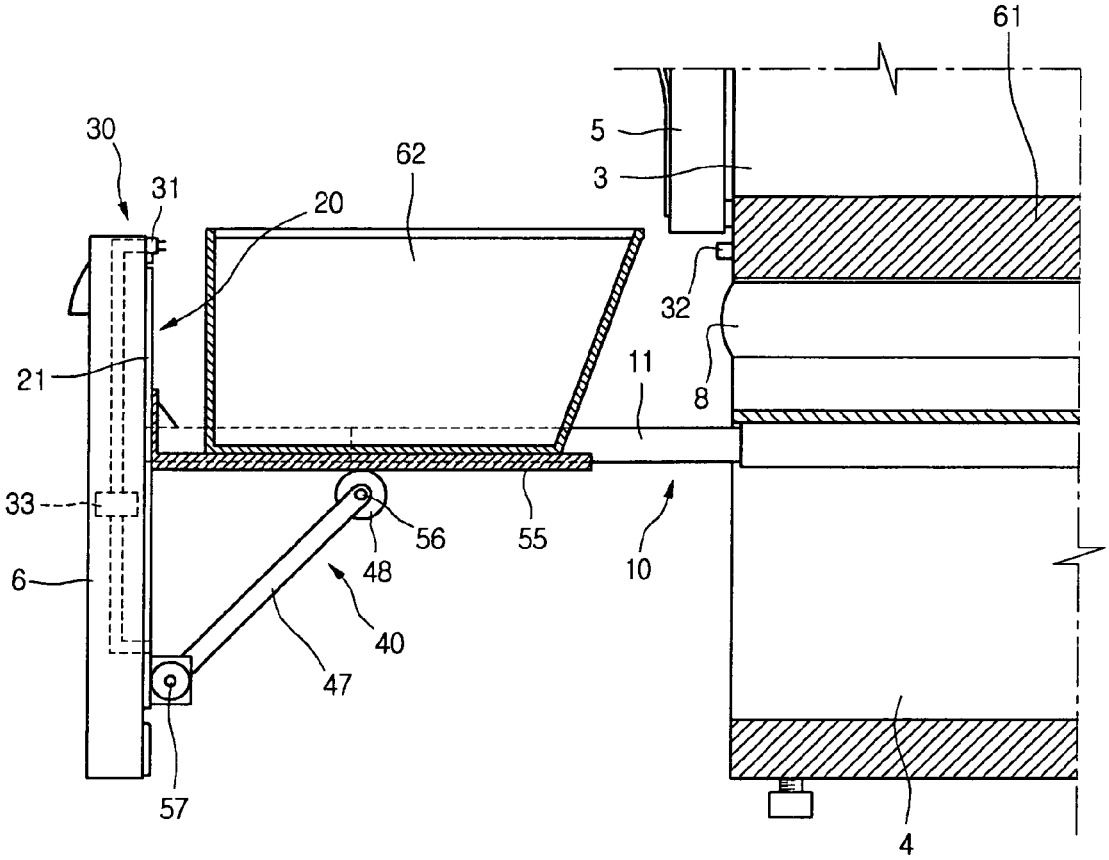
FIG. 3 shows a container that is lifted from a position depicted in FIG. 2.

The lifting and lowering of the container 62 will now be described with reference to accompanying drawings. FIG. 2 is a sectional view taken along line I-I' in FIG. 1, and FIG. 3 shows a container that is lifted from a position depicted in FIG. 2. Referring to FIGS. 2 and 3, a container moving system in the illustrate embodiment includes an actuating unit 40, a vertical guide unit 20, and a power supply unit 30. The actuating unit 40 lifts up and lowers down the container supporter 55 along a rear wall of the second door 6. The vertical guide unit 20 guides the lifting and lowering of the container supporter 55. The power supply unit 30 supplies power to the actuating unit 40. It should be noted that in the illustrated embodiment the container moving system moves the container supporter 55 along the vertical direction. However, the present invention can also be applied to move the container supporter along the horizontal or other directions.

The refrigerator 1 further includes a compartment wall 61 between the first chamber 3 and the second chamber 4. The drawers 8 are placed under the compartment wall 61 to provide storages at a constant temperature. That is, food and other substances requiring a constant temperature condition can be kept in the drawers 8.

When the second door 6 is extended outward, the slider 10 stably guides the second door 6. After the second door is fully extended, the actuating unit 40 operates to lift up the container supporter 55. Accordingly, the lifting of the container supporter 55 is stably guided by the vertical guide unit 20. The power supply unit 30 controls power supply to the actuating unit 40.

The slider 10 includes a pair of horizontal rails 11. An inner rail is mounted on an inner side of the main body 2 and an outer rail is mounted on an outer side of the second door 6. The inner rail and the outer rail are slidably engaged with each other such that the outer rail can be slid in and out when the second door 6 is closed and open.

The vertical guide unit 20 is provided to guide the container supporter 55 when the container supporter 55 is lifted up and lowered down. The vertical guide unit 20 includes a vertical rail 21 fixed to the rear surface of the second door 6. The vertical rail 21 defines a groove (refer to the reference numeral 22 in FIG. 4) running its length to receive a protrusion formed on a corresponding side of the container supporter 55, such that the lifting and lowering of the container supporter 55 can be exactly guided by the vertical rail 21.

To lift the container supporter 55, the actuating unit 40 includes an arm support 57 fixed to the rear surface of the second door 6, an rotary arm 47 hinged on the arm support 57 and extended toward the inside of the refrigerator 1, a free end 56 of the rotary arm 47, and a roller 48 rotatably fixed to the free end 56 to make contact with the container supporter 55 at a bottom of the container supporter 55. The actuating unit 40 further includes a motor (refer to the reference numeral 41 in FIG. 4) to rotate the rotary arm. The actuating unit 40 will be further described later.

Figure 4:
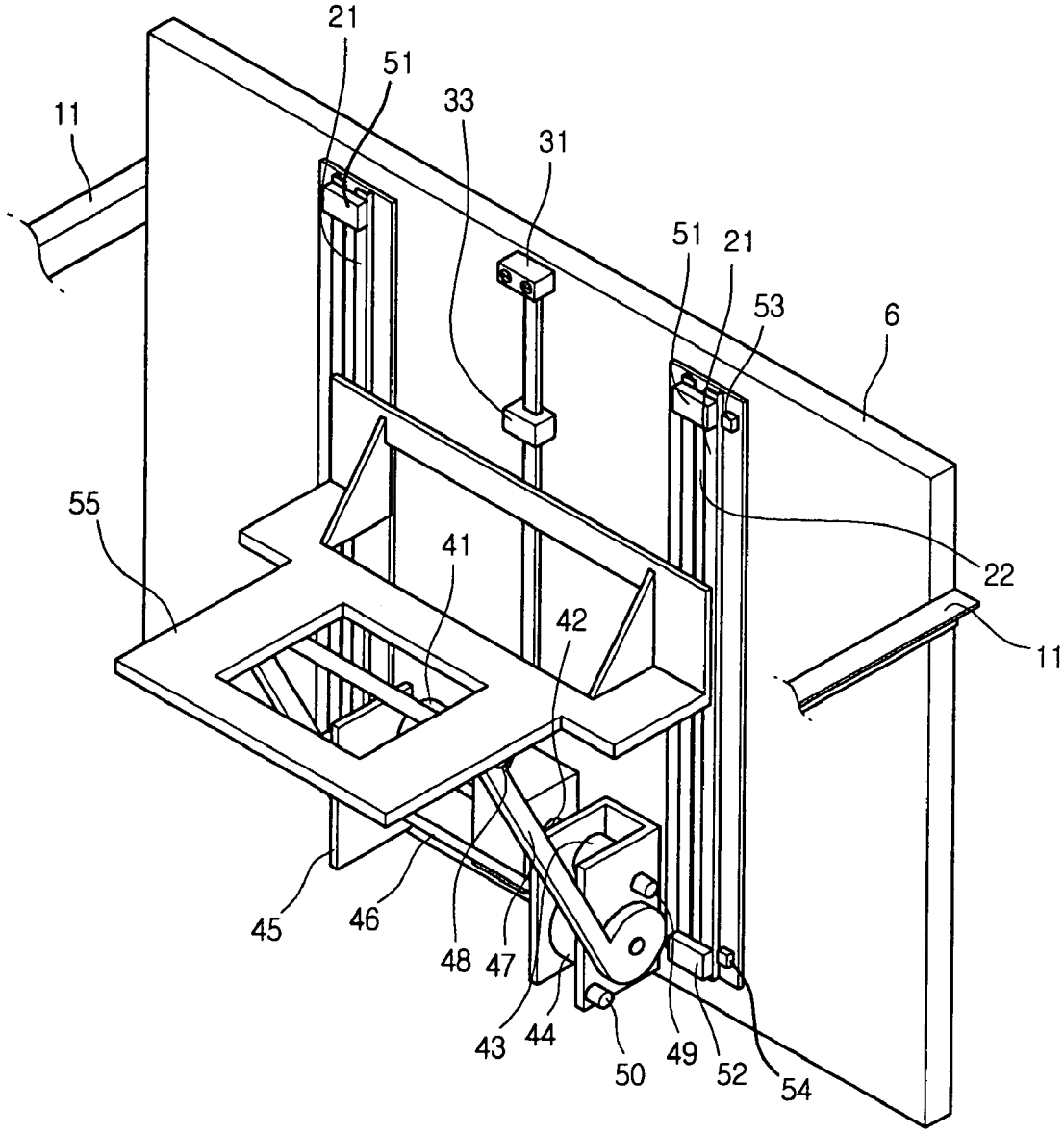
FIG. 4 is a rear perspective view of a door according to an embodiment of the present invention.

The power supply unit 30 includes a battery 33 connected to the motor 41 to supply power to the motor 41. The battery can be located at any place, e.g., within the door 6 as shown in FIG. 3, on the rear side of the door 6 as shown in FIG. 4, or on/within the main body 2 with a wiring connection to the motor 41. The charging terminal 31 is connected to the batter 33 via a wire connection, and the charging terminal 31 comes into contact with the power terminal 32 formed on the main body 2 when the second door 6 is closed.

The lifting of the container 62 will now be described more fully. First, when a user presses a lift-up button of the control switch buttons 7 after the second door 6 is fully open, the battery 33 supplies power to the motor 41. The battery can be recharged when the second door 6 is closed and the charging terminal 31 and the power terminal 32 are connected.

When the power is on, the motor 41 rotates the rotary arm 47 about the arm support 57 in an upward direction. Thus, the roller 48 as it turns pushes the container supporter 55 upward to lift up the container 62.

The relationship between the rotary arm 47 and the container supporter 55 can be clearly understood with reference to FIGS. 2 and 3, which respectively show the container 62 before and after the lifting.

The power supply unit 30 is provided with the battery 33. When the second door 6 is closed, the battery 33 is charged by receiving power from the main body 2 through the power terminal 32 and the charging terminal 31. Therefore, the battery 33 can supply power to the motor 41 when the two terminals 32 and 31 are disconnected because of the opening of the second door 6.

That is, since the power supply unit 30 is provided with the rechargeable battery 33, in this illustrated embodiment, an additional wire connection is not required between the main body 2 and the second door 6 to supply power to the motor 41 when the second door 6 is open. Therefore, the container moving system can be simply constructed and conveniently used.

Figure 5:
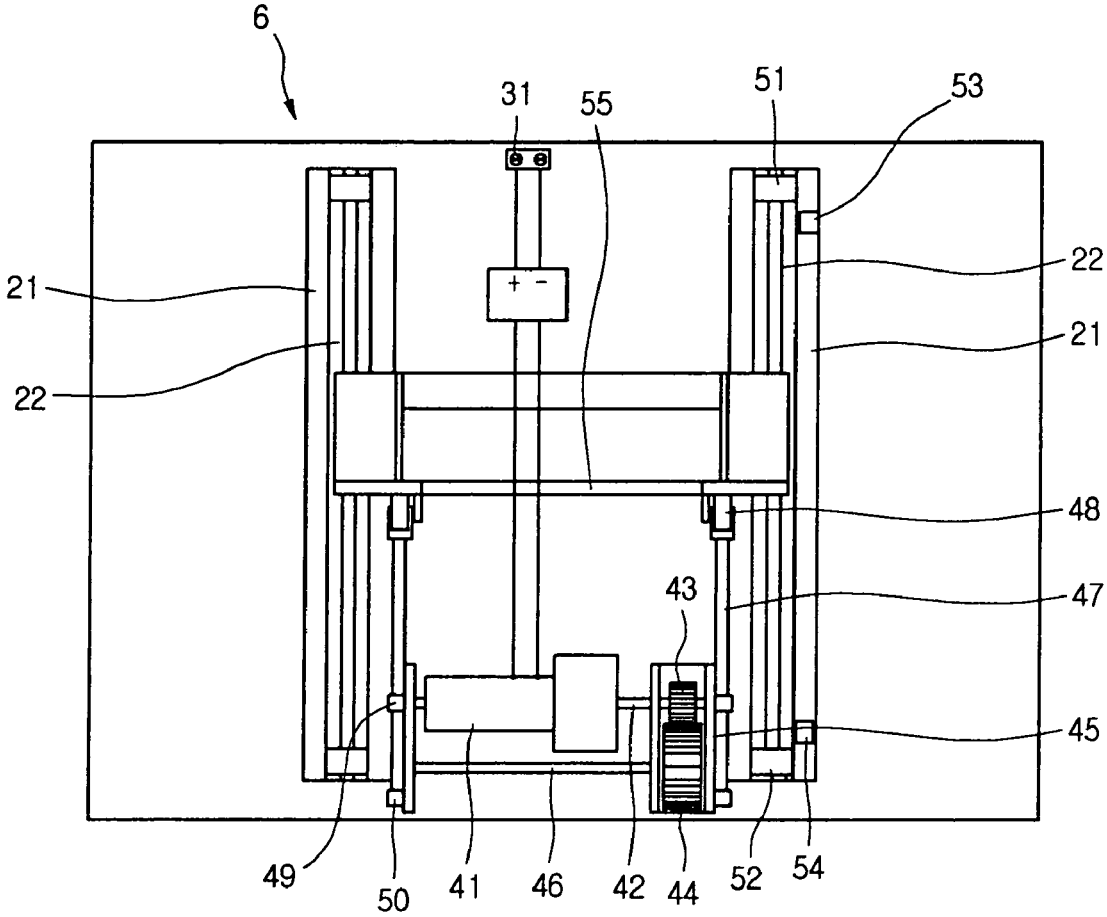
FIG. 5 is a rear view of a door according to an embodiment of the present invention.

FIG. 4 is a rear perspective view of the second door 6 according to an embodiment of the present invention, and FIG. 5 is a rear view of the second door 6 according to an embodiment of the present invention. An operation of the refrigerator with the container moving system will now be more fully described with reference to FIGS. 4 and 5.

The actuating unit 40 includes the motor 41 installed on the rear surface of the second door 6, a motor shaft 42 coupled with a rotor of the motor 41, a driving gear 43 connected to the motor shaft 42, a driven gear 44 engaged with the driving gear 43, an arm shaft 46 coupled to a center of the driven gear 44, and the rotary arm 47 fixed to an end of the arm shaft 46. A gear support 45 is fixed to the rear surface of the second door 6 to support the driving gear 43 and the driven gear 44.

In the illustrate embodiment, there are two rotary arm 47 that are respectively coupled to both ends of the arm shaft 46. Therefore, the container supporter 55 can be supported at both sides by the rotary arms 47 and thus it can be stably lifted.

The gear support 45 includes an arm stopping structure such as a first arm stopper 49 and a second arm stopper 50 that are projected from a surface of the gear support 45 to restrict the rotation of the rotary arm 47 to a predetermined angle range. That is, the container supporter 55 can be limited between the non-lifted and lifted positions. For example, even when the motor 41 is not properly controlled, the arm stoppers 49 and 50 can prevent the rotary arm from over-rotation.

Another stopping structure can be formed on the vertical rail 21 to stop the container supporter 55. That is, the upper and lower stoppers 51 and 52 may be formed on the upper and lower ends of the vertical rail 21 in order to further limit the container supporter 55 between the non-lifted and lifted positions. Therefore, the container moving system can be more reliably operated.

A sensing unit is provided to detect the up and down motions of the container supporter 55. For example, the upper and lower sensors 53 and 54 are respectively installed on the upper and lower ends of the vertical rail 21 to detect the lifting and lowering of the container supporter 55. Both of the contact type sensor and the optical type sensor can be used for the upper and lower sensors 53 and 54. Based on the detection of the upper and lower sensors 53 and 54, the power supply to the motor 41 may be controlled.

Operational steps of the container moving system will now be described in detail. When the second door 6 is closed, the power terminal 32 and the charging terminal 31 come into contact with each other so that the battery 33 can be charged. When a user presses a lift-up button of the control switch buttons 7 after the second door 6 is open, the battery 33 supplies power to the motor 41 to drive it. Driving force is transmitted from the motor shaft 42 to the rotary arm 47 through the driving gear 43, the driven gear 44, and the arm shaft 46. Upon the rotation of the rotary arm 47, the roller 48 on the free end 56 of the rotary arm 47 pushes up the container supporter 55.

When the container supporter 55 is completely lifted up, the upper sensor 53 detects the container supporter 55. In response to the detection of the container supporter 55 by the upper sensor 53, the motor 41 is powered off to stop rotating the rotary arm 47 and lifting the container supporter 55. Further, when the container supporter 55 is completely lifted up, the container supporter 55 is prevented from being further lifted up by the physical structure of the upper stopper 51 and/or the first arm stopper 49. Therefore, even if the upper sensor 53 failed to detect the completely lifted container supporter 55, the container supporter 55 would be prevented from being over-lifted. This increases the reliability of the actuating unit 40.

The container supporter 55 is lowered down in the same way as it is lifted up. Merely, the motor is rotated in the reverse direction.

Figure 6:
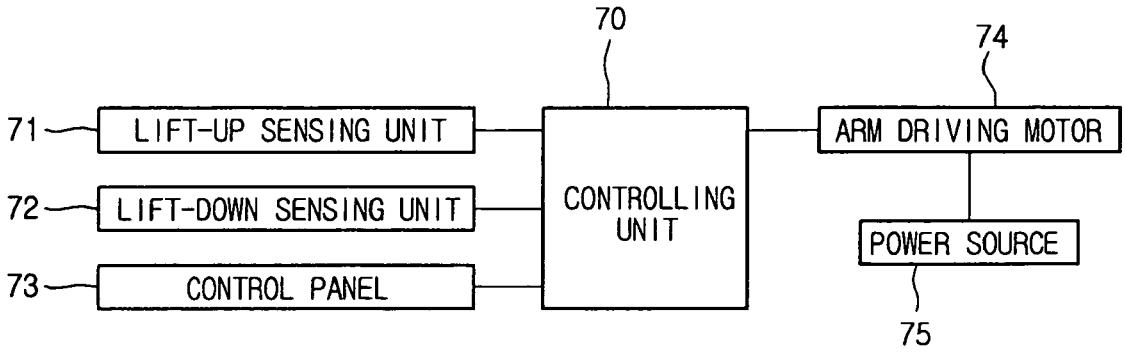
FIG. 6 is a block diagram of a container moving system for a refrigerator according to an embodiment of the present invention.

FIG. 6 is a block diagram of a container moving system for a refrigerator according to an embodiment of the present invention. Referring to FIG. 6, a container moving system of the illustrated embodiment includes: a lift-up sensing unit 71 to detect the container 62 when it is completely lifted up; a lowered-down sensing unit 72 to detect the container 62 when it is completely lowered down; a control panel 73 to receive inputs from a user; a controlling unit 70 to output control signals according to signals from the lift-up sensing unit 71, the lowered-down sensing unit 72, and the control panel 73; an arm driving motor 74 capable of operating under the control of the controlling unit 70; and a power source 75 to supply power to the arm driving motor 74.

The control panel may be the control switch buttons 7 that are formed on the front surface of the second door 6. The lift-up sensing unit 71 and the lowered-down sensing unit 72 may be respectively the upper sensor 53 and the lower sensor 54 that are installed on the upper and lower ends of the vertical rail 21. The power source 75 may include the battery 33 to supply power to the arm driving motor 74.

The lift-up operation of the container moving system is as follows: a lift-up button of the control panel 73 is pressed; the arm driving motor 74 is operated to lift up the container supporter 55; the lift-up sensing unit 71 detects the container supporter unit 55 when the container supporter 55 is completely lifted up; and the arm driving motor 74 stops. The lowered-down operation of the container moving system is carried out in a similar way.

As described above, the container is automatically lifted up and lowered down by the container moving system such that users can use the container more easily and conveniently.

Further, the power source (e.g., the battery) is charged when the door is closed and it supplies power to the motor when the door is open, such that an additional power supply unit or a lead wire is not required to supply power to the motor.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A refrigerator comprising:

a main body including at least one chamber;

a door selectively opening and closing the chamber;

a container accommodated in the chamber, the container being movable along a first direction and along a second direction;

a container supporter movably located on a side of the door facing the chamber to support the container;

a rotary arm rotatably mounted on a rear of the door, the container being movable along the first direction by moving the door along the first direction, and the container being movable along the second direction by rotating the rotary arm;

a motor for driving the rotary arm;

a gear connected to a motor shaft of the motor, one end of the rotary arm being connected to the gear for rotation within a predetermined angle to move the container along the second direction and the other end abutted on the container supporter;

a roller rotatably located on the other end of the rotary arm to make rolling contact with the container supporter when the motor moves the container supporter along the second direction; and a battery electrically connected to the motor to supply power to the motor.

2. The refrigerator according to claim 1, wherein the first direction is a horizontal direction and the second direction is a vertical direction.

3. The refrigerator according to claim 1, further comprising an arm shaft inserted into the one end of the rotary arm to support the rotary arm.

4. The refrigerator according to claim 1, further comprising:

a charging terminal formed on the door and connected to the battery; and a power terminal formed on the main body for selectively connecting the charging terminal.

5. The refrigerator according to claim 4, wherein the charging terminal is connected to the power terminal for charging the battery when the door is closed and the charging terminal is disconnected from the power terminal when the door is open.

6. The refrigerator according to claim 1, further comprising a stopper to restrict movement of the container along the second direction to a predetermined range.

7. The refrigerator according to claim 1, further comprising a sensor to detect movement of the container along the second direction.

8. A container moving system comprising:

a door configured to selectively open and close a chamber by moving in a horizontal direction;

a container supporter moveably mounted on a side of the door in a vertical direction;

a container seated on the container supporter;

a rotary arm rotatably provided to allow the container supporter to move in the vertical direction;

a battery mounted on a portion of the door, the battery being chargeable when the door is closed;

a motor located on the side of the door and receiving power from the battery to move the container supporter along the vertical direction by driving the rotary arm;

at least one gear connected to a shaft of the motor, the rotary arm having a first end abutted on the container supporter and a second end connected with the at least one gear, for rotation within a predetermined angle range to move the container supporter along the first vertical direction; and a roller rotatably located on the first end of the rotary arm to make rolling contact with the container supporter when the motor move the container supporter along the vertical direction.

9. The container moving system according to claim 8, further comprising an arm shaft inserted into the second end of the rotary arm to support the rotary arm.

10. The container moving system according to claim 8, further comprising an arm stopping structure to prevent over-rotation of the rotary arm.

11. The container moving system according to claim 8, further comprising:

a guide unit to guide movement of the container supporter along the vertical direction; and a stopping structure to restrict the movement of the container supporter along the vertical direction to a predetermined range.

12. The container moving system according to claim 8, further comprising at least one sensing unit located on the side of the door to detect movement of the container along the vertical direction.

13. The container moving system according to claim 8, wherein the battery is configured to supply power to the motor when the door is open.

14. A refrigerator comprising:

a main body including at least one chamber;

a door selectively opening and closing the chamber;

a container accommodated in the chamber, the container being movable along a first direction and along a second direction;

a container supporter movably located on a side of the door facing the chamber to support the container;

a rotary arm rotatably mounted on a rear of the door, the container being movable along the first direction by moving the door along the first direction, and the container being movable along the second direction by rotating the rotary arm;

a motor for driving the rotary arm;

a gear connected to a motor shaft of the motor, one end of the rotary arm being connected to the gear for rotation within a predetermined angle to move the container along the second direction and the other end abutted on the container supporter;

an arm shaft inserted into the one end of the rotary arm to support the rotary arm; and a battery electrically connected to the motor to supply power to the motor.

15. A container moving system comprising:

a door configured to selectively open and close a chamber by moving in a horizontal direction;

a container supporter moveably mounted on a side of the door in a vertical direction;

a container seated on the container supporter;

a rotary arm rotatably provided to allow the container supporter to move in the vertical direction;

a battery mounted on a portion of the door, the battery being chargeable when the door is closed;

a motor located on the side of the door and receiving power from the battery to move the container supporter along the vertical direction by driving the rotary arm;

at least one gear connected to a shaft of the motor, the rotary arm having a first end abutted on the container supporter and a second end connected with the at least one gear, for rotation within a predetermined angle range to move the container supporter along the first vertical direction; and an arm shaft inserted into the second end of the rotary arm to support the rotary arm.

* * * * *